US008894463B2

(12) United States Patent
Chan et al.

(10) Patent No.: US 8,894,463 B2
(45) Date of Patent: Nov. 25, 2014

(54) TOY FIGURE ASSEMBLY WITH TOY FIGURE AND SURFBOARD

(75) Inventors: Patricia Chan, Redondo Beach, CA (US); Steven Ryniker, Torrance, CA (US); Andrew Wong, Torrance, CA (US)

(73) Assignee: Mattel, Inc., El Segundo, CA (US)

( * ) Notice: Subject to any disclaimer, the term of this patent is extended or adjusted under 35 U.S.C. 154(b) by 243 days.

(21) Appl. No.: 13/315,958

(22) Filed: Dec. 9, 2011

(65) Prior Publication Data

US 2013/0052910 A1 Feb. 28, 2013

Related U.S. Application Data

(63) Continuation-in-part of application No. 13/220,191, filed on Aug. 29, 2011, now abandoned.

(51) Int. Cl.
*A63H 3/00* (2006.01)

(52) U.S. Cl.
USPC ..... 446/268; 446/72

(58) Field of Classification Search
USPC ..... 446/71, 72, 73, 153, 268, 321
See application file for complete search history.

(56) References Cited

U.S. PATENT DOCUMENTS

| | | | | |
|---|---|---|---|---|
| 1,539,251 | A | 5/1925 | Findlay | |
| 1,550,309 | A * | 8/1925 | Esser | 446/291 |
| 1,803,197 | A * | 4/1931 | Marie | 446/294 |
| 2,183,144 | A * | 12/1939 | McIntyre | 446/380 |
| 2,638,348 | A | 5/1953 | Arenson et al. | |
| 2,814,909 | A | 12/1957 | Knowles | |
| 3,344,449 | A * | 10/1967 | Grilli | 441/60 |
| 3,392,986 | A * | 7/1968 | Ryan et al. | 280/11.115 |
| 3,574,969 | A * | 4/1971 | Cleveland et al. | 446/275 |
| 3,852,911 | A | 12/1974 | Sapkus et al. | |
| 3,874,112 | A | 4/1975 | Sapkus et al. | |
| 3,927,883 | A | 12/1975 | Bosley et al. | |
| 3,946,520 | A | 3/1976 | Goldfarb et al. | |
| 4,031,657 | A | 6/1977 | Crosman et al. | |
| 4,091,563 | A | 5/1978 | Noble et al. | |
| 4,186,518 | A | 2/1980 | Luke | |
| 4,518,366 | A | 5/1985 | Fultz, Jr. et al. | |
| 4,923,427 | A * | 5/1990 | Roland | 446/153 |
| 4,979,924 | A | 12/1990 | Manger | |
| 5,009,424 | A | 4/1991 | Harth et al. | |
| 5,046,986 | A | 9/1991 | Wood et al. | |
| 5,149,289 | A | 9/1992 | Edwards et al. | |
| 5,299,967 | A | 4/1994 | Gilbert | |
| 5,458,523 | A | 10/1995 | Aoki et al. | |
| 6,102,767 | A | 8/2000 | Wiggs et al. | |
| 6,425,796 | B1 | 7/2002 | Gaynor et al. | |
| 6,431,940 | B1 * | 8/2002 | Buford et al. | 446/277 |
| 6,726,523 | B2 * | 4/2004 | Baker et al. | 446/225 |
| 6,887,121 | B2 | 5/2005 | Whitehead | |

(Continued)

*Primary Examiner* — Vishu K. Mendiratta

(74) *Attorney, Agent, or Firm* — Edell, Shapiro & Finnan LLC

(57) ABSTRACT

A toy figure assembly is disclosed. The toy figure assembly includes a toy figure and a toy surfboard that can be used with the toy figure. In one embodiment, the toy figure can be coupled to the toy surfboard in an upright or surfing orientation that simulates the toy figure surfing on the toy surfboard. In one embodiment, the toy figure can be coupled to the toy surfboard in a lying orientation that simulates the toy figure paddling on the toy surfboard. In one embodiment, a handle is coupleable to the toy figure to allow a user to move the toy figure into different poses.

8 Claims, 15 Drawing Sheets

(56) References Cited

U.S. PATENT DOCUMENTS

| | | | | |
|---|---|---|---|---|
| 6,939,196 | B2 * | 9/2005 | Bellon | 446/366 |
| 7,244,164 | B2 | 7/2007 | Isenberg | |
| 7,255,625 | B2 | 8/2007 | Bellon | |
| 7,318,766 | B2 | 1/2008 | Marine et al. | |
| 7,338,342 | B2 | 3/2008 | Bellon | |
| 7,854,643 | B2 | 12/2010 | Kane | |
| 7,857,678 | B2 | 12/2010 | Isenberg | |
| 2002/0086609 | A1 | 7/2002 | Donohoe | |
| 2005/0170746 | A1 | 8/2005 | Wee | |
| 2005/0191936 | A1 | 9/2005 | Marine et al. | |
| 2007/0197126 | A1 | 8/2007 | Derrah | |
| 2007/0254556 | A1 * | 11/2007 | Whitaker | 446/390 |
| 2010/0093254 | A1 | 4/2010 | Jung | |

* cited by examiner

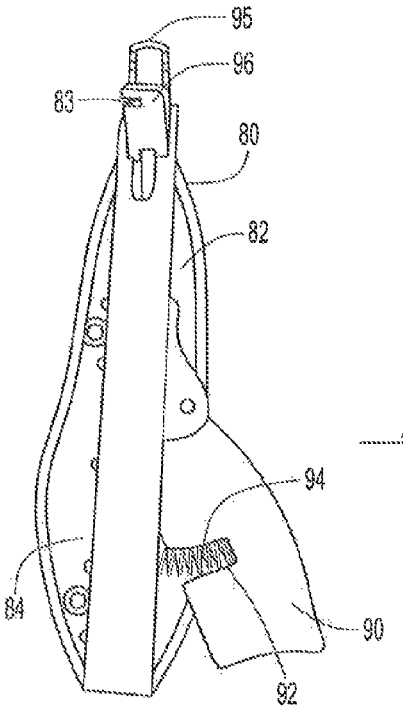
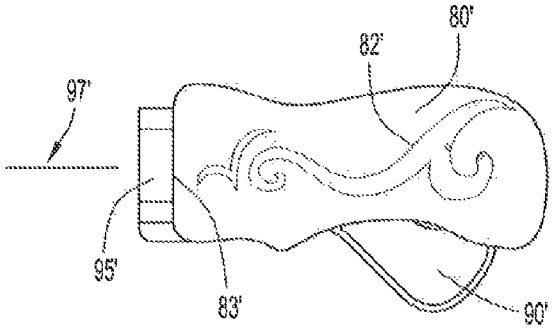
FIG.7
FIG.6
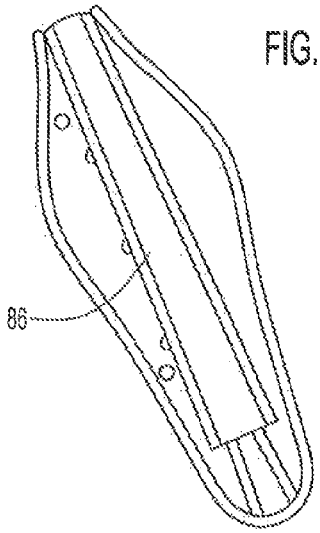

TOY FIGURE ASSEMBLY WITH TOY FIGURE AND SURFBOARD

CROSS-REFERENCE TO RELATED PATENT APPLICATION

This application is a continuation-in-part of and claims priority to U.S. patent application Ser. No. 13/220,191, filed Aug. 29, 2011 now abandoned, entitled "Toy Figure Assembly with Toy Figure and Surfboard," the entire disclosure of which is incorporated herein in its entirety.

FIELD OF THE INVENTION

The present invention relates to a toy figure assembly, and in particular, to a toy figure assembly that includes a toy figure and a toy surfboard that can be used with the toy figure.

BACKGROUND OF THE INVENTION

Conventional toy figures, such as dolls, are used in various play environments by children. Play using a toy figure can be enhanced via accessories designed for use with the toy figure.

There is a need for an accessory that can be used with a toy figure to provide options to reconfigure the toy figure and the accessory.

SUMMARY OF THE INVENTION

The toy figure assembly includes a toy figure and a toy surfboard that can be used with the toy figure. In one embodiment, the toy figure and surfboard can be placed into a configuration resembling a surfer. The toy figure can be coupled to the toy surfboard in an upright or surfing orientation that simulates the toy figure surfing on the toy surfboard. In one embodiment, the toy figure can be coupled to the toy surfboard in a lying orientation that simulates the toy figure paddling on the toy surfboard. In one embodiment, a handle is coupleable to the toy figure to allow a user to move the toy figure into different poses and/or move the toy figure. The toy figure and toy surfboard can be reconfigured into a mermaid configuration in which the toy surfboard forms part of the mermaid appearance.

In one embodiment, a toy figure assembly comprises a toy figure having a torso portion and a pair of legs coupled to the torso portion; and a toy surfboard having a fabric member coupled thereto, the fabric member and the toy surfboard forming a pocket therebetween, the pocket being configured to receive the legs of the toy figure so that the toy surfboard forms an apparel component for the toy figure when the legs are inserted in the pocket.

In an alternative embodiment, the toy surfboard includes a fin movably coupled thereto, the fin being retractable and extendable relative to the pocket.

In an alternative embodiment, the fabric member has a first edge and a second edge, the toy surfboard has a first end and a second end, the second edge being proximate to the second end.

In an alternative embodiment, the toy surfboard includes a fin movably coupled thereto, the fin being retractable and extendable relative to the pocket, the fin extending from the second end of the toy surfboard and the second edge of the fabric member.

In an alternative embodiment, the toy surfboard has an actuator coupled to the fin, the actuator being manipulatable to move the fin from an extended position to a retracted position.

In an alternative embodiment, the toy surfboard includes a coupler, the coupler being configured to receive a portion of the toy figure to couple the toy figure to the toy surfboard.

In an alternative embodiment, the coupler engages one of a foot of the toy figure or the torso portion of the toy figure.

In an alternative embodiment, the toy figure is in a standing orientation when a foot of the toy figure is engaged with the coupler, and the toy figure is in a lying orientation when the torso portion of the toy figure is engaged with the coupler.

In an alternative embodiment, the toy assembly further comprises a handle coupleable to the toy figure, the handle being manipulatable by a user to move the toy figure.

In an alternative embodiment, the torso of the toy figure has an opening, and a portion of the handle is insertable into the opening of the toy figure.

In another embodiment, a toy figure assembly comprises a toy figure having a torso portion and pair of legs coupled to the torso portion, each of the legs including a foot; and a toy surfboard having a first side and a second side, the first side of the toy surfboard having couplers mounted thereto, the couplers being configured to receive the feet of the toy figure to support the toy figure in a standing orientation relative to the first side, the second side of the toy surfboard having a flexible member coupled thereto, the flexible member and the surfboard defining a pocket configured to receive the legs of the toy figure so that the toy figure appears to be wearing the flexible member.

In an alternative embodiment, the flexible member includes a fabric member, the legs of the toy figure being insertable between the fabric member and the toy surfboard.

In an alternative embodiment, the toy surfboard includes a fin member that is movable relative to the toy surfboard, the fin member being extendable and retractable relative to the pocket.

In an alternative embodiment, the toy surfboard includes an actuator coupled to the fin member, the fin member being movable by the actuator from an extended position to a retracted position.

In an alternative embodiment, the toy surfboard includes a mounting component that receives a portion of the toy figure to support the toy figure in a standing orientation on the toy surfboard.

In an alternative embodiment, the toy surfboard includes a mounting component that receives a portion of the toy figure to support the toy figure in a lying orientation on the toy surfboard.

In an alternative embodiment, the toy assembly further comprises a handle coupleable to the toy figure, the handle being movable to impart motion to the toy figure and to the toy surfboard when the toy figure is coupled to the toy surfboard.

In an alternative embodiment, the handle couples to the back of the toy figure.

In another embodiment, a toy surfboard for use with a toy figure having a torso and at least one leg coupled to the torso comprises a board; a fabric member having opposite sides and opposite ends, the sides of the fabric member being coupled to the board, the fabric member and the board forming a receptacle therebetween, the receptacle being configured to receive the at least one leg of the toy figure; and a fin-like structure insertable into the receptacle, the fin-like structure being movable between a retracted position and an extended position relative to the fabric member, the at least one leg of the toy figure engaging the fin-like structure and moving the fin-like structure to the extended position as the at least one leg is inserted into the receptacle.

In an alternative embodiment, the fin-like structure includes an elongate member coupled to the fin-like structure, and the fin-like structure moves to its retracted position when the elongate member is pulled.

BRIEF DESCRIPTION OF THE DRAWINGS

FIG. 6 illustrates an exploded side view of the handle illustrated in FIGS. 4 and 5.

FIG. 7 illustrates a side view of an alternative embodiment of a handle according to the present invention.

Like reference numerals have been used to identify like elements throughout this disclosure.

DETAILED DESCRIPTION OF THE INVENTION

The present invention relates to a toy figure assembly that includes a toy figure and a toy surfboard. The term "toy figure" is includes, but is not limited to, a doll, an action figure, a character, a figurine, or other figure. The term "surfboard" is used interchangeably with the term "board" herein.

Figure 1:
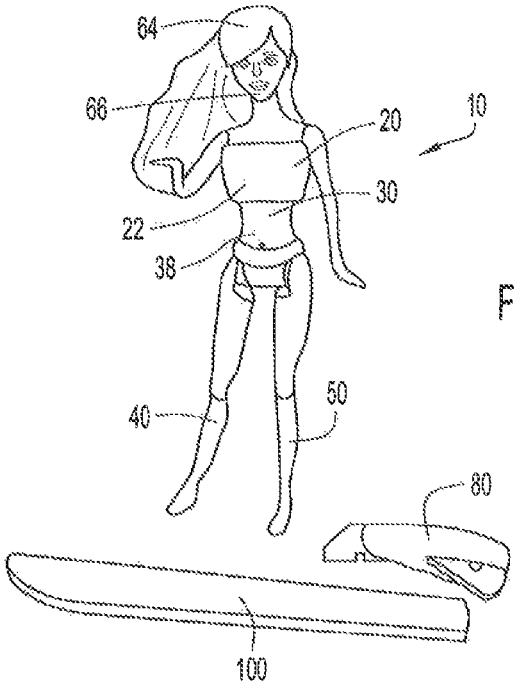
FIG. 1 illustrates a perspective view of a toy assembly according to the present invention.
Figure 20:
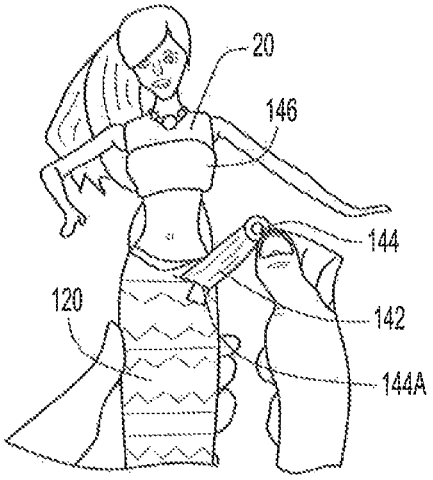
FIGS. 20-21 illustrate front views of the toy figure illustrated in FIG. 1 showing the repositioning of some softgoods accessories.

Referring to FIG. 1, an embodiment of a toy figure assembly is illustrated. In this embodiment, the toy figure assembly 10 includes a toy FIG. 20 and a toy surfboard or board 100 to which the toy FIG. 20 is coupleable. The toy FIG. 20 includes a torso or torso portion 22 that has a front surface 30 and a waist portion 38. The toy FIG. 20 also includes a pair of legs 40 and 50 that are coupled to the torso 22 and a pair of arms that are coupled to the torso 22. In this embodiment, one of the arms is bent and the other arm is straight. In other embodiments, the arms can be movable and poseable.

The toy FIG. 20 also includes a head 64 coupled to the torso 22 via a neck joint 66. The neck joint 66 permits the head 64 to move relative to the torso 22. As a result, a child is able to move the toy figure's head 64 so that it looks up and forward when the toy FIG. 20 is lying down on the board 100.

The toy figure assembly 10 also includes a handle or lever 80 that is coupleable to the toy FIG. 20. As described below, the handle 80, when coupled to the toy FIG. 20, can be manipulated by a user, such as a child, to move the toy FIG. 20 and the surfboard 100 therewith manually.

Figure 2:
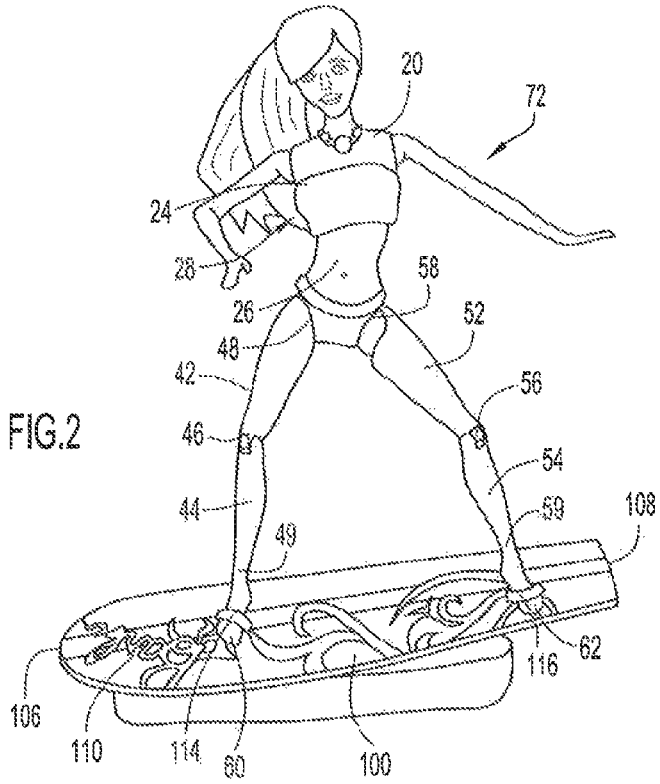
FIG. 2 illustrates a front perspective view of a toy figure coupled to the toy surfboard illustrated in FIG. 1.

Referring to FIG. 2, the toy FIG. 20 is coupled to the toy surfboard 100 and has a surfer configuration 72. In this embodiment, the toy FIG. 20 has several joints that permit relative movement of different portions of the toy FIG. 20 and also permit the posing of various appendages of the toy FIG. 20.

The torso 22 of the toy FIG. 20 includes an upper portion 24 and a lower portion 26 that are movably coupled together via a joint 28. The joint 28 is a ball and socket joint that permits the upper torso portion 24 and the lower torso portion 26 to pivot relative to each other. In an alternative embodiment, a joint other than a ball and socket joint can be used. The pivoting connection between the upper torso portion 24 and the lower torso portion 26 allows the toy figure to imitate surfing motions. When the upper torso portion 24 is held, the lower torso portion 26 and legs 40 and 50, which are coupled to the board 100, swing and rotate like a pendulum, which simulates the toy FIG. 20 trying to balance on the board 100.

The legs 40 and 50 of the toy FIG. 20 include joints and are poseable as well. In this embodiment, the legs 40 and 50 include upper leg portions 42 and 52, lower leg portions 44 and 54, and feet 60 and 62, respectively. Leg portions 42 and 44 are pivotally coupled together via a joint 46. Similarly, leg portions 52 and 54 are pivotally coupled together via a joint 56. In addition, the upper leg portions 42 and 52 are coupled to the torso portion 26 via joints 48 and 58 as shown. In this embodiment, the toy FIG. 20 also has ankle joints 49 and 59 that permit the movement of the feet 60 and 62 relative to the legs 40 and 50. The joints permit the relative movement of the legs and feet, which allows a child to change the configurations and appearance of the legs 40 and 50. In addition, the joints permit relative movement of the leg portions when the toy FIG. 20 is moved by a child.

Figure 3:
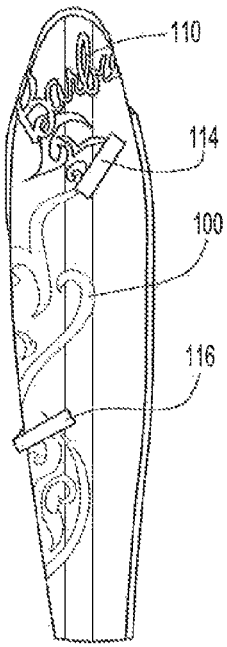
FIG. 3 illustrates a top view of the toy surfboard illustrated in FIG. 1.

The toy surfboard 100 includes opposite ends 106 and 108 and two opposite surfaces. Surface 110 is illustrated in FIG. 2 and resembles a surface of a surfboard on which the toy FIG. 20 simulates surfing activities. Referring to FIGS. 2 and 3, mounting components or couplers 114 and 116 are coupled to the surfboard 100. In this embodiment, each of the couplers 114 and 116 defines an opening or passageway with the surface 110 into which one of the feet 60 or 62 of the toy FIG. 20 can be inserted. The feet 60 and 62 are slid beneath the couplers 114 and 116, which retain the feet 60 and 62 on the board 110 via friction. As a result, the toy FIG. 20 is supported on the board 110 in a surfer configuration 72. In one embodiment, the couplers 114 and 116 are elastic members. In another embodiment, the couplers 114 and 116 are plastic members.

In an alternative embodiment, the toy surfboard 100 includes another coupler that receives at least part of the waist portion 38 of the toy FIG. 20 when the toy FIG. 20 is placed with the front surface 30 of its torso 22 on the board 100, such as a lying down or prone orientation. This coupler can be a clip or elastic strap that extends around part or all of the waist portion 38, thereby holding the toy FIG. 20 in a "paddling out" like orientation on the board 100.

The surfboard 100 includes an internal structural member, such as a piece of foam, that is either covered by a layer of material on both sides or is otherwise decorated.

Once the toy FIG. 20 is coupled to the surfboard 100, creative play using the toy FIG. 20 and the board 100 to simulate surfing of waves by the toy FIG. 20 is possible. A child is able maneuver the toy FIG. 20 and surfboard 100 manually by holding onto part of either the toy FIG. 20 or the surfboard 100. Alternatively, a child is able to use a handle coupled to the toy FIG. 20 to impart movement to the toy FIG. 20 and surfboard.

Figure 2A:
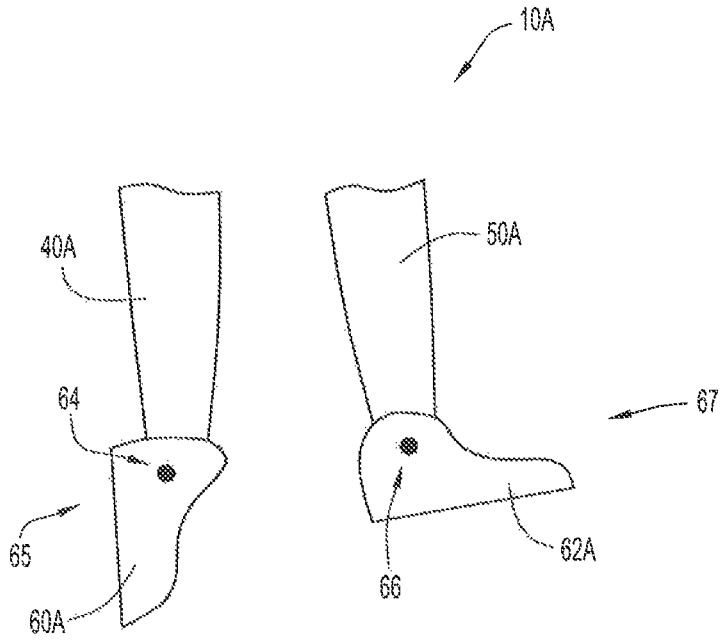
FIG. 2A illustrates a side view of a portion of an alternative embodiment of a toy figure according to the present invention.
Figure 10:
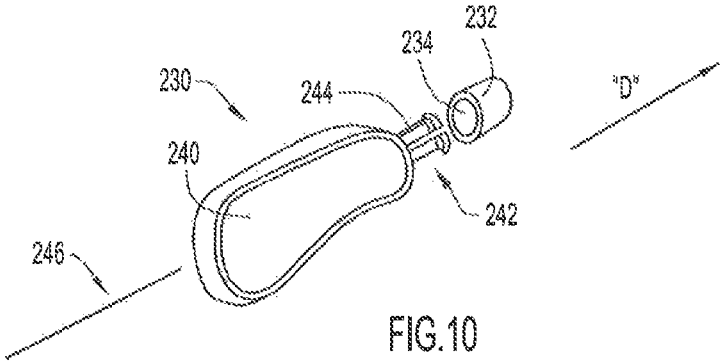
FIG. 10 illustrates a perspective view of another embodiment of a handle according to the present invention.

In an alternative embodiment, the feet of the toy figure are pivotally coupled to the legs of the toy figure. Referring to FIG. 2A, a portion of toy FIG. 10A is illustrated. As shown, the toy FIG. 10 includes legs 40A and 50A with feet 60A and 62A, respectively. Foot 60A is coupled to leg 40A by a connector, such as a pin, and is pivotable about pivot point 64. Similarly, foot 60B is coupled to leg 50A via a connector and is pivotable about pivot point 66. The feet 60A and 62A are independently rotatable to a mermaid position or orientation 65 and to a surfer position or orientation 67. In the mermaid position 65, the feet 60A and 62A are oriented properly for the transformation from a surfer configuration to a mermaid configuration (as described below). In the surfer position 67, the feet 60A and 62A are oriented so that they can be coupled to the board as described above.

Figure 4:
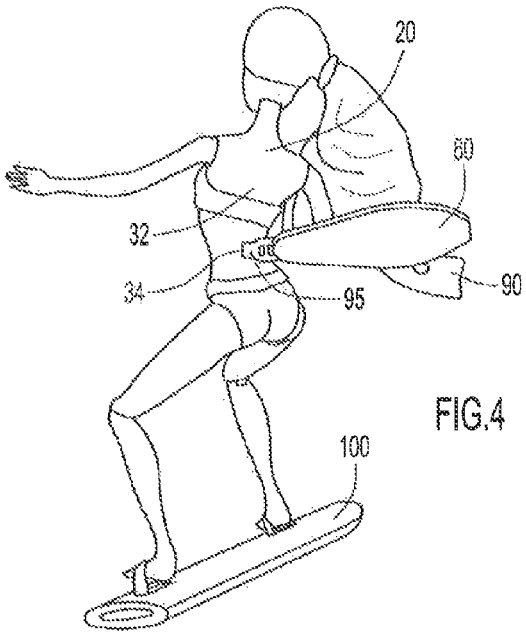
FIG. 4 illustrates a rear perspective view of the toy figure coupled to the toy surfboard illustrated in FIG. 2.

Referring to FIG. 4, a handle 80 is coupled to the toy FIG. 20. In particular, the rear surface 32 of the torso 22 includes a mounting component or opening 34 formed therein. While the opening 34 is illustrated as being in the middle to lower portion of the torso 22, in another embodiment, the opening 34 is located in the rear surface of the upper portion of the torso 22.

The handle 80 includes an end 95 that is inserted into the mounting component or opening 34. The handle 80 is useable by the child to move the toy FIG. 20. The handle 80 also includes a trigger 90 that is depressible relative to the rest of the handle 80. When the trigger 90 is pressed, the toy FIG. 20 moves relative to the handle 80, and in particular, relative to the portion of the handle 80 that is being held by the child.

Figure 4A:
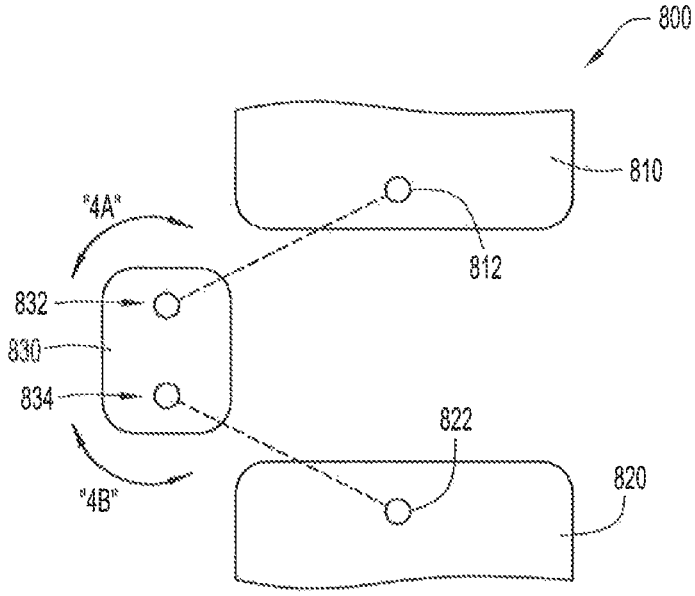
FIG. 4A illustrates an exploded view of components of an alternative embodiment of a toy figure according to the present invention.

Referring to FIG. 4A, some components of an alternative embodiment of a toy figure according to the present invention are illustrated. Toy FIG. 800 includes an upper torso portion 810, a lower torso portion 820, and a linkage 830 that is coupled to the portions 810 and 820. Linkage 830 is coupled at point 832 to the upper torso portion 810 at point 812 by a connector, which enables linkage 830 to rotate back and forth along the directions of arrow "4A" about point 832. Similarly, linkage 830 is coupled at point 834 to the lower torso portion 820 at point 822 by a connector, which enables the lower torso portion 820 to pivot about point 822 along the directions of arrow "4B." The linkage 830 provides a loose and floppy torso for the toy figure. When a handle is coupled to upper torso portion 810, any movement of upper torso portion 810 results in movement of linkage 830 and lower torso portion 820. The compound movements of the torso parts create the visual appearance of surfing by the toy figure.

Figure 5:
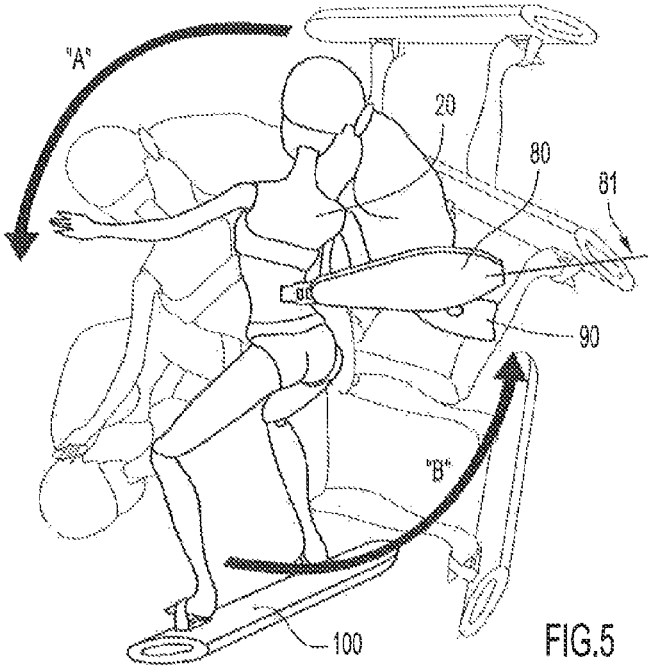
FIG. 5 illustrates a rear perspective view of the toy figure illustrated in FIG. 2 in multiple orientations.

Referring to FIG. 5, one embodiment of handle is illustrated. In this embodiment, the handle 80 rotates the toy FIG. 20 in a 360 degree manner. The handle 80 defines an axis 81 about which the toy FIG. 20 and board 100 rotate. As the child presses the trigger 90, the activation end of the handle and the toy FIG. 20 coupled thereto rotate about axis 81 along the directions of arrows "A" and "B." One actuation of the trigger 90 results in a 360 degree spin or rotation of the toy figure. Multiple actuations of the trigger 90 result in the continuous rotation of the toy FIG. 20 about axis 81 for each actuation.

Referring to FIG. 6, some of the components of the handle 80 are illustrated. In this embodiment, the handle 80 includes a housing 82 which is formed of housing portions 84 and 86 that are coupled together to define an interior region or chamber. The handle 80 includes an elongate member 88 that extends slightly beyond the end 83 of the housing 82. The trigger 90 is pivotally coupled to the elongate member 88 and includes a notch 92 in which a spring 94 is positioned. The trigger 90 is connected to a movable piece 96 is that rotatably coupled to the elongate member 88. Piece 96 is movable relative to the end 95 that is insertable into the opening 34 in the torso 22 of the toy FIG. 20.

As a child presses the trigger 90, the movement of the trigger 90 is translated into rotation of the end 95 relative to the housing 82. Since the end 95 is coupled to the toy FIG. 20, rotation of the end 95 causes corresponding rotation of the toy FIG. 20.

An alternative embodiment of a handle is illustrated in FIG. 7. In this embodiment, the handle 80' includes a housing 82' with a trigger 90' movably coupled thereto. Extending from end 83' of the housing 82' is an activation end 95' that is inserted into the opening 34 in the toy FIG. 20 and rotates relative to the housing 82'. The activation end 95' is mounted for rotation about axis 97', which is substantially horizontal when the toy figure is oriented in a substantially vertical manner.

Activation end 95' is inserted into an opening formed in the back of the toy figure. The handle 80' includes an internal rack of teeth that is coupled to the activation end 95'. Coupled to the trigger 90' is a set of teeth that engages the rack of teeth coupled to activation end 95'. When the trigger 90' is pushed inwardly, the activation end 95' rotates about axis 97' due to the engagement of the teeth. The continued engagement of the trigger 90' results in the rotation and revolution of the activation end 95', which causes the toy figure coupled to the handle 80' to rotate about an axis that extends along the longitudinal axis of the handle 80'.

Figure 8:
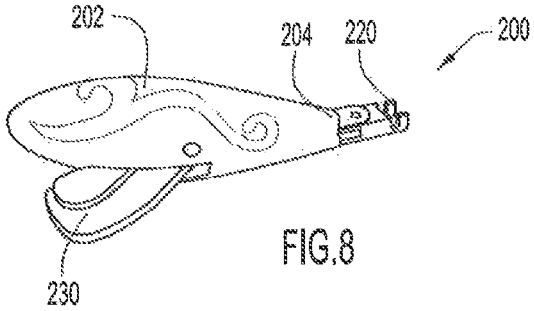
FIG. 8 illustrates a perspective view of another embodiment of a handle according to the present invention.
Figure 9:
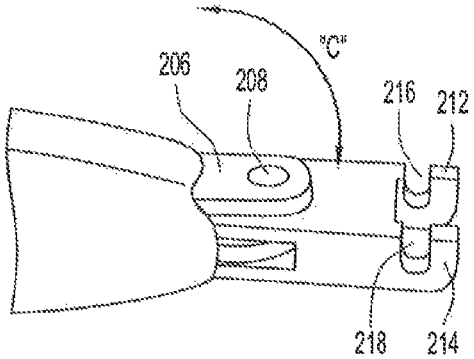
FIG. 9 illustrates a close-up perspective view of a portion of the handle illustrated in FIG. 8.

Another embodiment of a handle according to the present invention is illustrated in FIGS. 8 and 9. This handle 200 functions in a similar manner to the handle illustrated in FIG. 6 and described above. In this embodiment, the handle 200 is coupleable to the toy FIG. 20 and pivots the toy FIG. 20 90 degrees to the left when the trigger 230 is pressed. When the trigger 230 is released, the toy FIG. 20 pivots back 90 degrees to the right to its original position. This motion of the toy FIG. 20 is referred to as "carving a wave" and is generally in a side-to-side manner. Since the handle 80 is coupled to the upper torso portion 24, the lower torso portion 26 can articulate relative thereto.

As shown in FIG. 8, the handle 200 includes a housing 202 with an end 204 from which an output end 220 extends. Referring to FIG. 9, the housing 202 includes a pair of extensions 206 that have holes 208 into which a connector (not shown) is insertable to pivotally connect a coupler 210 to the housing 202. The coupler 210 has a pair of fingers 212 and 214 that are formed by grooves 216 and 218, respectively. In one embodiment, a component, such as a bar or rod, on the toy FIG. 20 can be engaged with the grooves 216 and 218 to couple the toy FIG. 20 to the handle 80. In an alternative embodiment, the fingers or tabs 212 and 214 latch into a pair of slots formed on the back of the torso of the toy figure. In one implementation, the slots are formed in the upper torso portion of the toy figure, which results in the lower torso portion and the board moving relative thereto when the handle 200 is actuated. When the trigger 230 is pressed, the coupler 210 moves to the left along the direction of arrow "C" and then back to the right along the opposite direction of arrow "C."

Figure 8A:
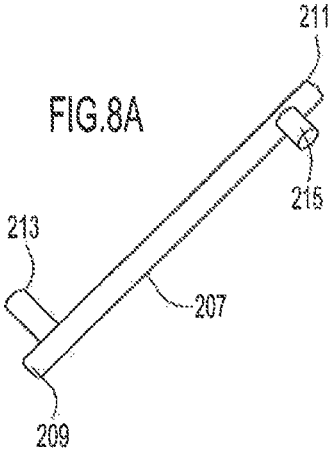
FIG. 8A illustrates a perspective view of an embodiment of a link of the handle illustrated in FIG. 8.

In handle 200, movement of the trigger 230 about a first axis results in movement of the output end 220 of the handle 200 about a second axis that is substantially perpendicular to the first axis. The 90 degree difference in movement between the trigger 230 and the output end 220 is due to a link 207, which takes the in and out movement of the trigger 230 and converts it to side-to-side movement of the output end 220. Referring to FIG. 8A, the connector or link 207 is located between and coupled to each of the trigger 230 and the output end 220. Link 207 includes opposite ends 209 and 211 proximate to which openings are formed. The openings are configured to receive pins 213 and 215, respectively. Movement of the trigger 230 causes a corresponding movement of pin 213, which results in rotation of the link 207 about its longitudinal axis. The rotation of the link 207 moves pin 215, which causes the output end 220 to move as well.

Another embodiment of a handle according to the present invention is illustrated in FIG. 10. In this embodiment, the handle 230 is used for simple rotation of the toy FIG. 20 without a lever. The handle 230 includes a body 240 with a mounting end 242 with resilient arms 244. The body 240 defines an axis 246 that is a longitudinal axis. The handle 230 is useable with a sleeve 232 that is insertable into an opening on the back of the torso 22 of the toy figure. The sleeve 232 defines an opening or channel 234 into which the resilient arms 244 can be inserted. When the arms 244 are coupled to the sleeve 232, the sleeve 232 and toy FIG. 20 can rotate about axis 246 when the handle 230 is manually moved by the user. In an alternative embodiment, there is a click stop that ensures the spinning of the toy figure and the board stops at 360 degrees, thereby positioning the toy figure and board in an upright configuration so as to be rotated once again.

In addition to the surfer configuration described above, the toy FIG. 20 can be reconfigured or transformed to a mermaid configuration. The process of reconfiguring the toy FIG. 20 to the mermaid configuration is illustrated in FIGS. 11-22. Initially, the toy FIG. 20 is decoupled from the board 100 by removing the feet 60 and 62 from the couplers 114 and 116 of the board 100. The board 100 is then flipped over and the opposite side 104 of the board 100 from side 102 is used.

The surface of the board 100 opposite to surface 110 illustrated in FIG. 2 is shown in FIGS. 11-14. Side 104 includes a surface 112, opposite to surface 110, that has an appearance corresponding to a mermaid's tail. The surface 112 has a flexible member or fabric member 120 coupled thereto. The flexible member 120 and the surface 112 define a pocket or receptacle 140 therebetween. The fabric member 120 is a stretchable material, such as spandex.

Figure 11:
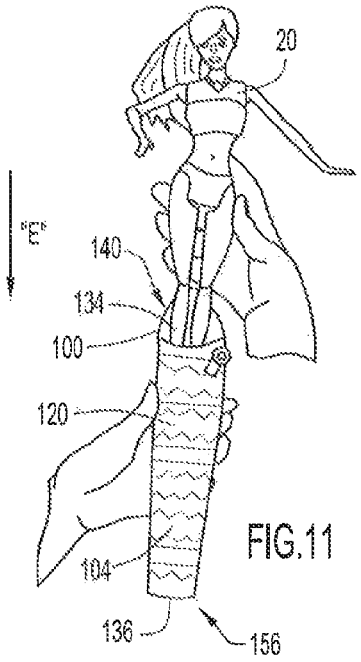
FIGS. 11-14 illustrate front views of the repositioning of the toy figure illustrated in FIG. 1 relative to the surfboard into a mermaid configuration.
Figure 12:
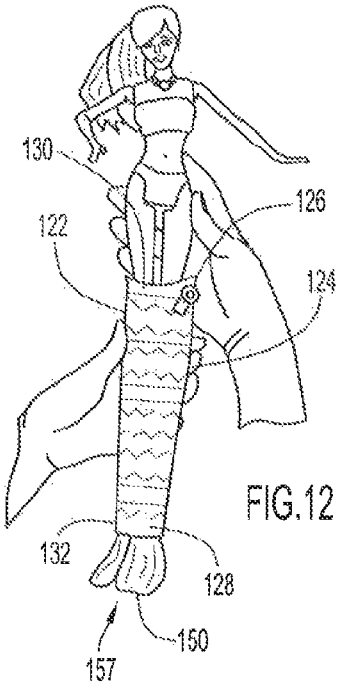

As shown in FIG. 12, the flexible member 120 has opposite sides 122 and 124 and opposite ends 126 and 128 that are defined by edges 130 and 132, respectively. Referring back to FIG. 11, the edges 130 and 132 of the flexible member 120 form openings 134 and 136 at its ends 126 and 128, respectively.

Figure 13:
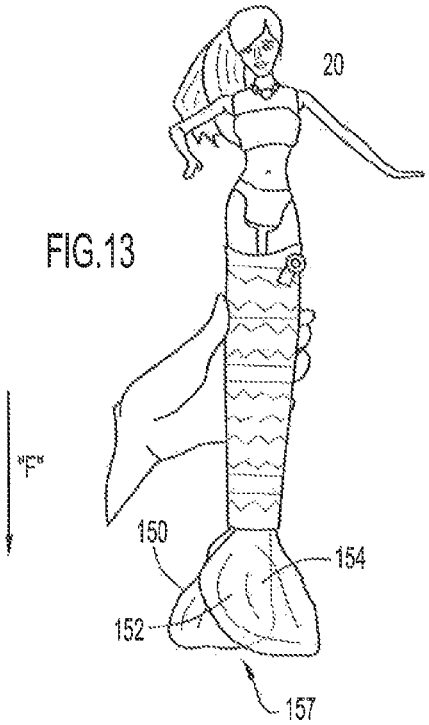

As shown in FIG. 11, the feet 60 and 62 of the toy FIG. 20 are inserted into the opening 134 along the direction of arrow "E." The continued movement of the toy FIG. 20 into the pocket 140 is illustrated in FIGS. 12 and 13. As the toy FIG. 20 is slid further into the pocket 140, the feet 60 and 62 of the toy figure engage a mechanism in the pocket 140 that is coupled to a fin or fin member 150. The fin can be referred to alternatively as a fin-like structure. Referring to FIG. 12, movement of the toy FIG. 20 results in the fin 150 moving outwardly from the pocket 140 through opening 136. The fin 150 moves from a retracted position 156 (see FIG. 11) to an intermediate position 157 (see FIG. 12).

Referring to FIG. 13, continued movement of the toy FIG. 20 along the direction of arrow "F" results in the movement of the fin 150 along the same direction. In this embodiment, the fin 150 includes two fin portions 152 and 154 that overlap each other in this intermediate position 157. The fin portions 152 and 154 are formed of softgoods material that are stretchable or flexible so that the fin portions 152 and 154 can move into and out of the pocket 140.

Figure 14:
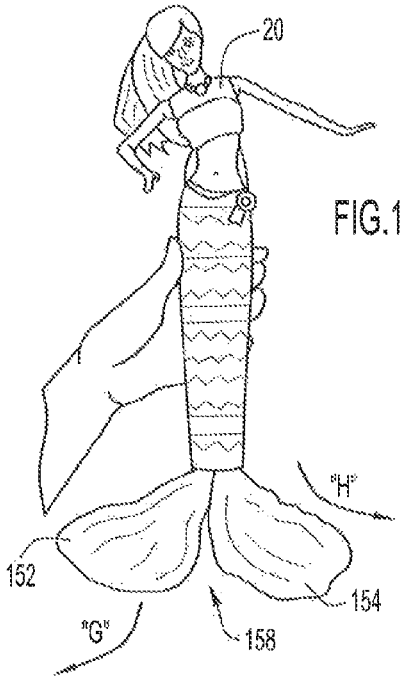

Referring to FIG. 14, the toy FIG. 20 has been completely inserted into the pocket 140. The fin members 152 and 154 have been moved along the directions of arrows "G" and "H" to their deployed positions in configuration 158. In this configuration, the fin members 152 and 154 resemble the tails of a mermaid.

Figure 15:
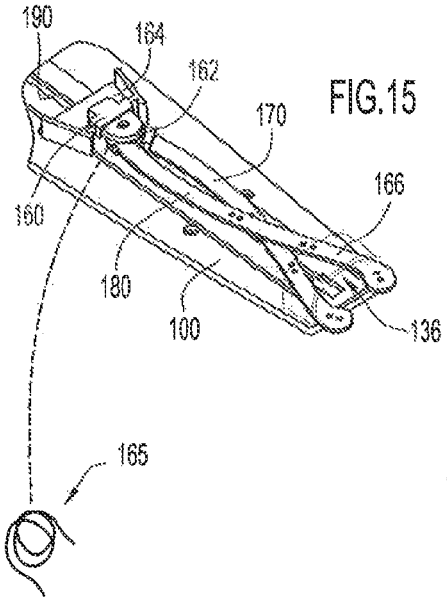
FIGS. 15-17 illustrate perspective views of components of the fin mechanism according to the present invention.
Figure 16:
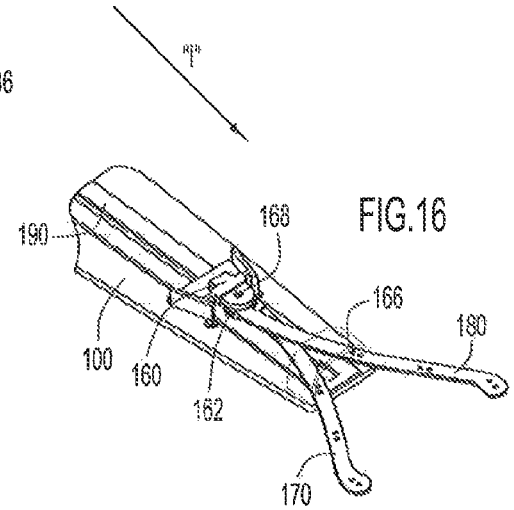
Figure 17:
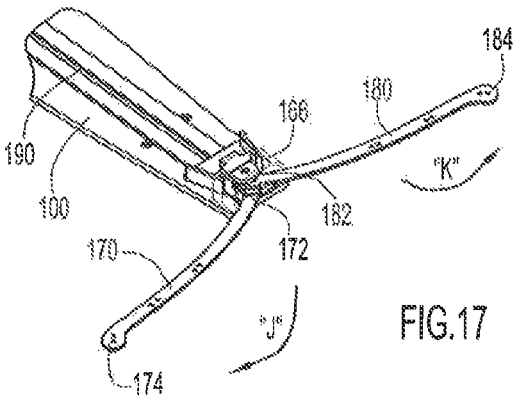

Referring to FIGS. 15-17, an embodiment of a mechanism used to deploy the fin members is illustrated. FIGS. 15-17 illustrate perspective views of a portion of the board 100 with the fabric member 120 removed so the internal components are viewable. Coupled to the board 100 is a rib or support 166 to which the fabric member 120 is coupled. The rib or support 166 defines the opening 136 through which the fin member 152 and 154 move.

In this embodiment, the fin deployment mechanism includes an engagement member 160 that has a mount 162 to which support arms 170 and 180 are movably coupled. The engagement member 160 has a surface 164 forming a foot base that is contacted or engaged by the feet 60 and 62 of the toy FIG. 20 as the toy FIG. 20 is inserted into the pocket 140.

The support arms 170 and 180 are formed of a resilient material, such as plastic or metal, and are configured so that the fabric material of the fin portions 152 and 154 can be coupled thereto, such as by stitching, sewing, a connector, or an adhesive. The support arms 170 and 180 provide some structure to the fin portions 152 and 154 so that the fin portions 152 and 154 can be extended and retracted easily.

The support arms 170 and 180 are pivotally coupled to the mount 162 via a connector 168 and are biased apart by a biasing mechanism 165, such as a spring. Referring to FIG.

15, the support arms 170 and 180 are prevent from moving outwardly by the engagement of the support arms 170 and 180 with the rib 166. As the toy FIG. 20 is inserted farther into the pocket 140 along the direction of arrow "I" (see FIG. 16), the engagement member 160 moves along the same direction. As more of the support arms 170 and 180 extend beyond the rib 166, the biasing member 165 causes the support arms 170 and 180 to move outwardly in opposite directions.

Referring to FIG. 17, the toy FIG. 20 has been inserted into the pocket 140 and the engagement member 160 has reached the end of its range of motion within the pocket 140. The support arms 170 and 180 are fully deployed and extend away from each other. The arms 170 and 180 are moved along the directions of arrows "J" and "K." Support arm 170 has a proximal end 172 coupled to the engagement member 160 and a distal end 174. Similarly, support arm 180 has a proximal end 182 coupled to the engagement member 160 and a distal end 184. A piece of material, such as a piece of fabric, is coupled to each of the support arms 170 and 180 and extends between ends 172 and 174 and ends 182, and 184, respectively.

As illustrated, the engagement member 160 has an actuator 190 coupled thereto. As described in greater detail below relative to FIGS. 23 and 24, the actuator 190 can be pulled by a child to move the engagement member 160 upwardly within the pocket 140 once the toy FIG. 20 has been removed.

Figure 18:
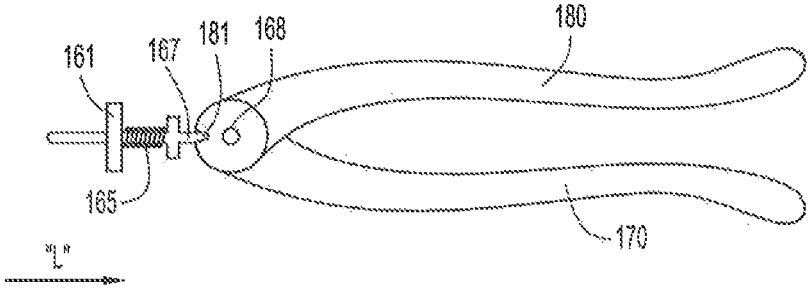
FIG. 18 illustrates a top view of the support arms of the fin mechanism illustrated in FIGS. 15-17.
Figure 19:
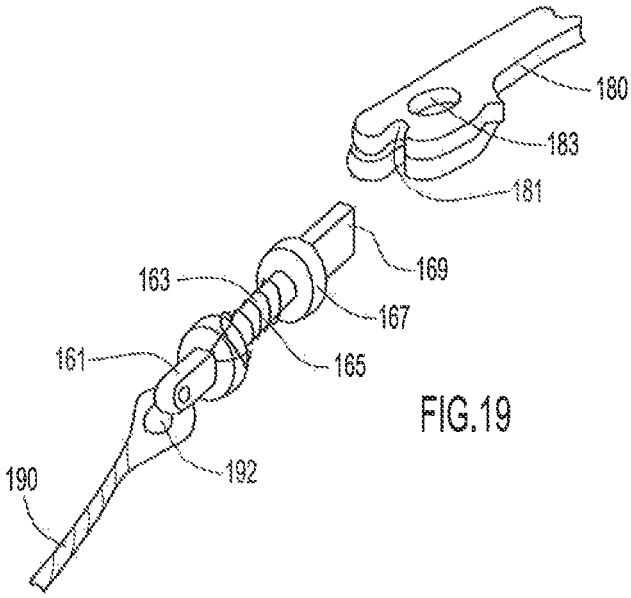
FIG. 19 illustrates a close-up exploded perspective view of some components of the fin mechanism illustrated in FIG. 18.

Referring to FIGS. 18 and 19, an alternative embodiment of some components of a fin mechanism is illustrated. In this embodiment, the fin mechanism includes a positioner that is used to retain or maintain the support arms 170 and 180 in a particular position. As shown, the positioner includes a body 161 that is coupled to the engagement member 160. A shaft 163 extends from the body 161 and has a spring 165 mounted thereon. A locking tab 167 with an edge 169 is mounted for movement relative to the body 161. The spring 165 biases the locking tab 167 along the direction of arrow "L" so that the edge 169 engages the arms 170 and 180.

As shown in FIG. 19, arm 180 has a notch 181 and a mounting hole 183. Hole 183 can receive a connector 168 that rotatably mounts the arm 180 (see FIG. 18). Referring to FIG. 18, the edge 169 of the detent is biased into engagement with the notch 181 in arm 180 and a corresponding notch in arm 170. When the arms 170 and 180 are moved far enough down the board 100, the locking tab 167 disengages from notch 181 and the arms 170 and 180 pop open and move apart.

In an alternative embodiment, end 192 of the actuator 190 is coupled to the body 161 as shown in FIG. 19.

Figure 19A:
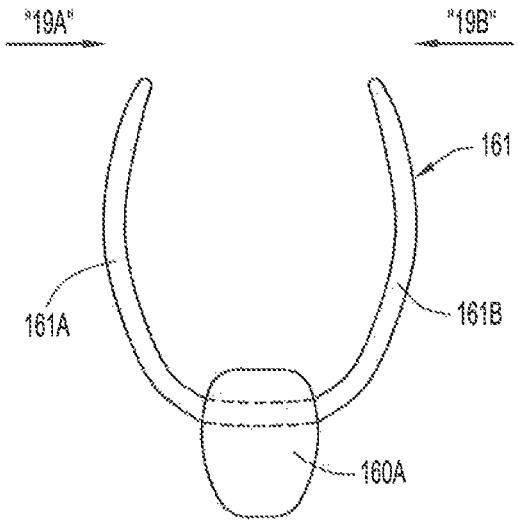
FIG. 19A illustrates a top view of an embodiment of a guide according to the present invention.

Referring to FIG. 19A, an alternative embodiment of a fin mechanism is illustrated. An engagement body 160A, which is coupled to a fin mechanism (not shown in FIG. 19A), is slidably mounted in the receptacle defined by the fabric member coupled to the surfboard. Also coupled to the body 160A is a guide 161 with resilient portions 161A and 161B that have distal ends. The resilient portions 161A and 161B of the guide 161, which may be a single member, are biased outwardly so that as the body 160A slides in the receptacle, the resilient portions 161A and 161B engage the inner walls of the receptacle of the fabric member and are biased inwardly along the directions of arrows "19A" and "19B." In this arrangement, the guide 161 and its resilient portions 161A and 161B are aligned within the receptacle. In an alternative embodiment, the guide 161 is formed of two separate resilient portions that are coupled to the body 160A.

Figure 19B:
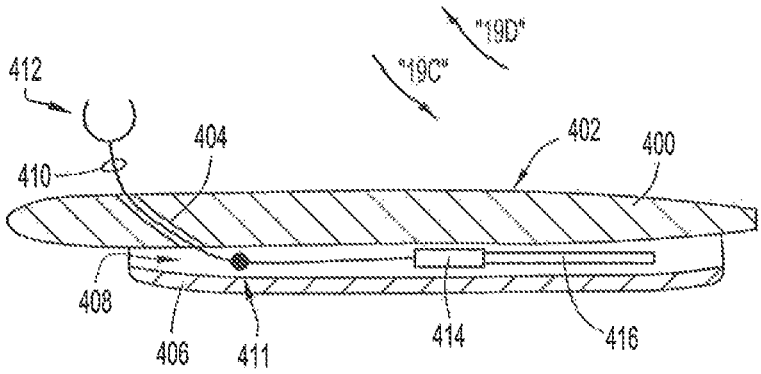
FIG. 19B illustrates a cross-sectional side view of an alternative embodiment of a board according to the present invention.

Referring to FIG. 19B, a cross-sectional view of an alternative embodiment of a board is illustrated. The board 400 has an outer surface 402 on one side that is a surfer surface and a fabric member 406 on an opposite side. The fabric member 406 defines a receptacle 408 in which the mermaid fin mechanism, including body 414 and fins 416, are located. In this embodiment, the board 400 includes a channel 404 formed therein that extends through the board 400 from one side to the other side.

An elongate member 410, such as a string, extends through the channel 404 and has a pair of opposite ends. One end of the elongate member 410 is coupled to the body 414 and the other end of the elongate member 410 has a clip 412 coupled thereto. The clip 412 is configured to engage a portion of the toy figure to couple the elongate member 410 to the toy figure. In this embodiment, the clip 412 is configured to be snapped onto the ankle of the toy figure. The clip 412 limits the movement of the elongate member 410 along the direction of arrow "19C," which corresponds to how the far the fins 416 extend from the fabric member 406 in the mermaid configuration. In one embodiment, the elongate member 410 includes a knot 411 formed therein that limits the movement of the elongate member 410 along the direction of arrow "19D."

Figure 21:
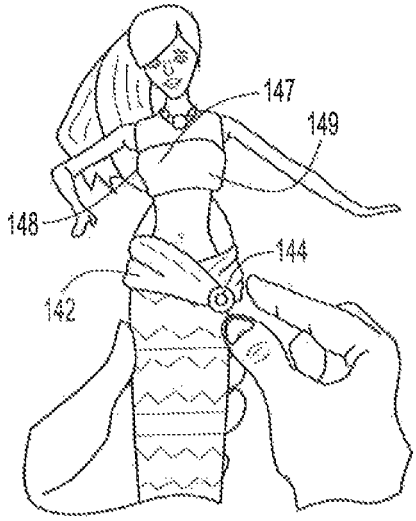
Figure 22:
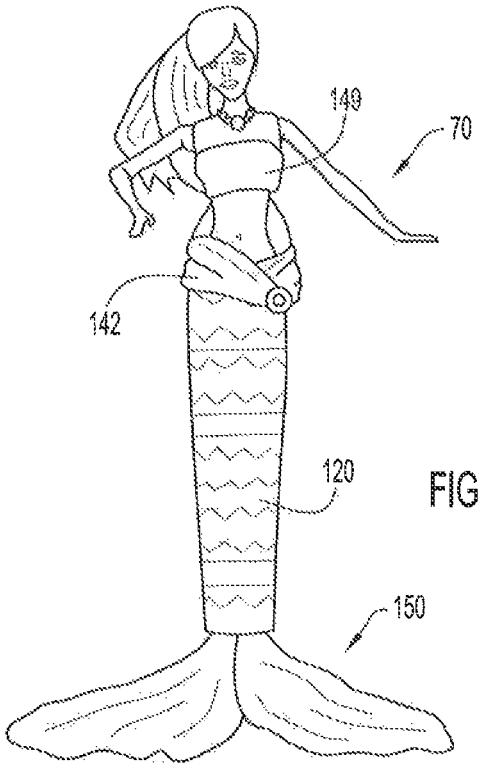
FIG. 22 illustrates a front view of the toy figure illustrated in FIG. 1 in a mermaid configuration.

Referring to FIGS. 20-22, additional features relating to the reconfiguring of the toy FIG. 20 are illustrated. The fabric member 120 includes a skirt ruffle 142 with a coupler 144 attached to an end thereof. The coupler 144 is one of a hook material or a loop material. The ruffle 142 is located in the pocket 140 can be pulled outwardly as illustrated in FIG. 15. A child is able to wrap the ruffle 142 around the waist of the toy FIG. 20 and attach the coupler 144 to the fabric member 120 and/or to the ruffle 142 as shown in FIG. 20.

In addition, the toy FIG. 20 includes a surfer top or suit 146 (see FIG. 20) that is reconfigurable as well. As shown in FIG. 21, the suit 146 has a base 149 with a flap of fabric 147 coupled thereto. The fabric 147 has a coupler 148 attached thereto. The coupler 148 keeps the flap 147 attached to the base 149 in the surfer configuration (see FIG. 20). Once the coupler 148 is decoupled, the flap 147 can be wrapped around the back of the toy FIG. 20 and the coupler 148 attached on the rear side of the toy FIG. 20. As result, the base 149 is exposed and provides a different appearance than the surfer suit, thereby enhancing the mermaid configuration 70 illustrated in FIG. 22. In one embodiment, the base 149 is a sculpted mermaid top or bodice that is formed as part of the toy FIG. 20. In another embodiment, the base 149 is a piece of material that is mounted to the body of the toy FIG. 20.

In the mermaid configuration 70, the fin or fin member 150 is fully deployed, as illustrated. Thus, the board 100 is used with the toy FIG. 20 in the surfer configuration and is also used with the toy figure in the mermaid configuration as part of the mermaid outfit or apparel component.

Figure 22A:
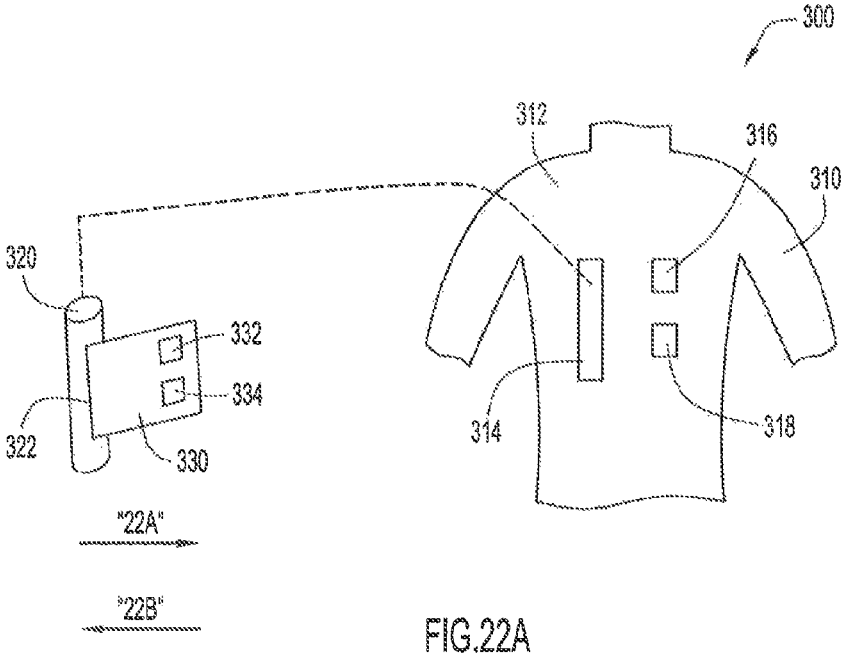
FIG. 22A illustrates a rear view of some components of an alternative embodiment of a toy figure according to the present invention.

Referring to FIG. 22A, a rear view of a portion of an alternative embodiment of a toy figure according to the present invention is illustrated. As shown, the toy FIG. 300 includes a body 310 with a rear surface 312 that has a slot 314 formed therein. Also located on the rear surface 312 are one or more couplers 316 and 318, each of which is one of a hook material and a loop material. The couplers 316 and 318 may be formed with the body 310 or formed separately and subsequently coupled thereto.

The toy FIG. 300 also includes a support 320 that is inserted into the slot 314 in the rear surface 312. The support 320 is a housing that defines an internal cavity into which a fabric member 330 extends through an opening 322 in the support 320. The fabric member 330 is biased inwardly along the direction of arrow "22B" by a biasing member, such as a spring. A child can pull the fabric member 330 along the direction of arrow "22A" so that it extends out of the support 320. When the fabric member 330 is pulled outwardly, it can be wrapped around the torso of the toy FIG. 300 and couplers 332 and 334 on the fabric member 330 can be placed in engagement with couplers 316 and 318, respectively, to hold the fabric member 330 in place about the toy figure's body.

Figure 23:
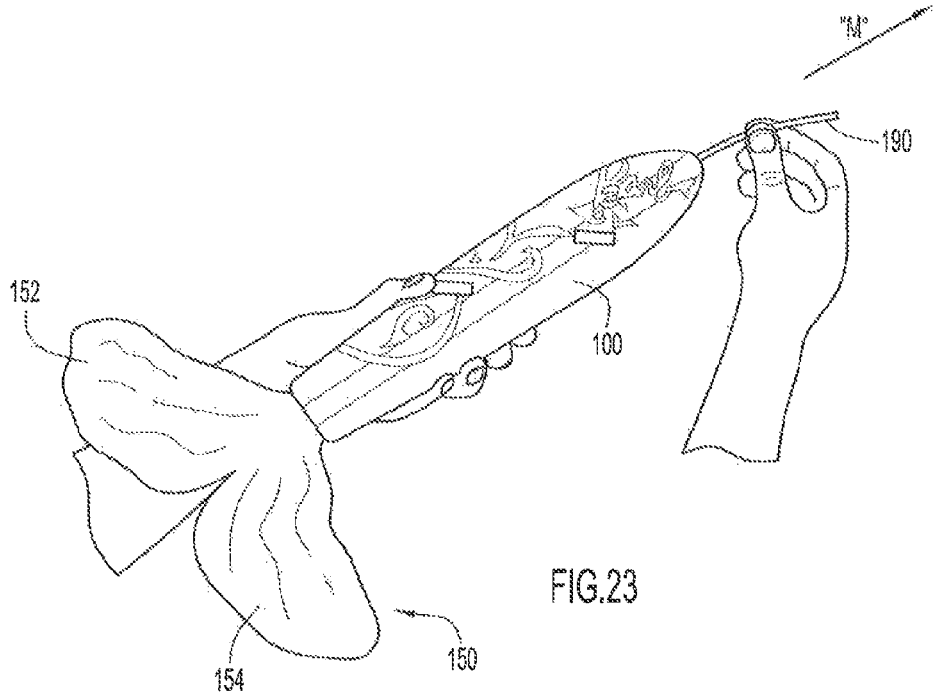
FIGS. 23-24 illustrate perspective views of the reconfiguration of the surfboard according to the present invention.
Figure 24:
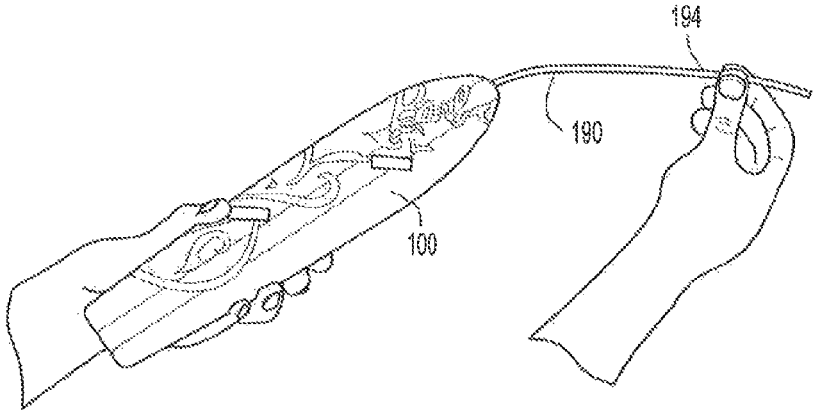

Referring to FIGS. 23 and 24, the reconfiguration of the surfboard 100 from its mermaid configuration to its surfer configuration is illustrated. In FIG. 23, the surfboard 100 in its mermaid configuration has the fin portions 152 and 154 of the fin member 150 extending outwardly therefrom. A child can pull on the actuator 190 along the direction of arrow "M" relative to the board 100. The movement of the actuator 190 in that direction results in movement of the engagement member 160 within the pocket 140 in the same direction. When the actuator 190 is pulled a sufficient distance, the fin portions 152 and 154 are retracted into the opening 138 and are located within the pocket 140.

Figure 25:
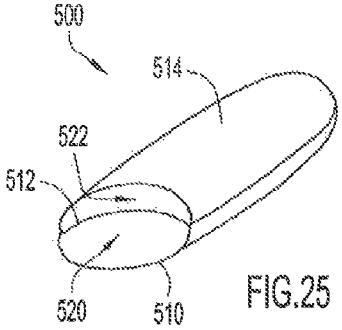
FIG. 25 illustrates a perspective view of a cover according to the present invention.

Referring to FIG. 25, an embodiment of a cover according to the present invention is illustrated. In this embodiment, the cover 500 includes several layers 510, 512, and 514 that are coupled together along their respective edges to form a receptacle 520 for the board and a receptacle 522 for the fin mechanism. In one implementation, the edges of layers 510, 512, and 514 are sewn together. The cover 500 is made of fabric and covers the board. The material of the board varies in different embodiments of the invention. Some exemplary materials include plastic, foam, a yoga mat, rubber, and a flexible molded material.

Figure 26:
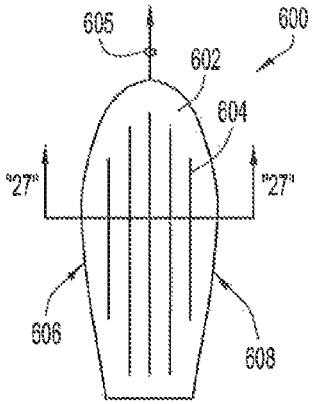
FIG. 26 illustrates a planar view of an alternative embodiment of a board according to the present invention.
Figure 27:
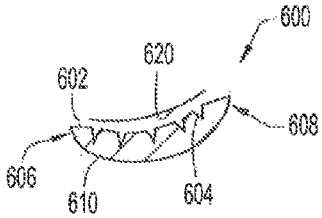
FIG. 27 illustrates a cross-sectional end view of the board illustrated in FIG. 26 taken along the line "27"-"27."

Referring to FIGS. 26 and 27, in one embodiment, a board 600 has a surface 602 proximate to which a toy figure is placed in the mermaid configuration. The board 600 has opposite sides 606 and 608. As shown in FIG. 26, the surface 602 of the board 600 has grooves 604 formed therein that increase the flexibility of the board 600. In this embodiment, the grooves 604 extend parallel to a longitudinal axis 605 of the board 600. As shown in FIG. 27, the grooves 604 permit the board 600 to flex or bend such that sides 606 and 608 move toward each other. A rear surface 620 of a toy figure that is placeable close to the board 600 is illustrated as well. As shown, the flexing or curving of the board 600 allows the board 600 to match the contour of and wrap around the rear surface 620 of the toy figure, thereby reducing the angle at which the toy figure projects from the board 600 in the mermaid configuration and increasing the overall alignment of the toy figure and the board 600.

Figure 28A:
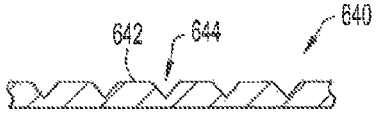
FIGS. 28A and 28B illustrate cross-sectional end views of portions of different embodiments of boards according to the present invention.
Figure 28B:
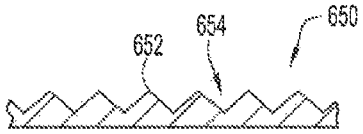
Figure 28:
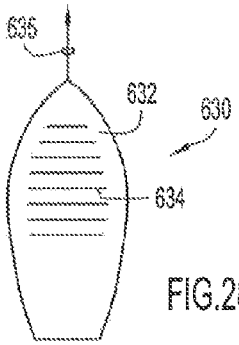
FIG. 28 illustrates a planar view of another embodiment of a board according to the present invention.

Referring to FIG. 28, an alternative embodiment of a board according to the present invention is illustrated. In this embodiment, the board 630 includes a surface 632 with grooves 634 formed therein. The grooves 634 are substantially perpendicular to a longitudinal axis 635 of the board 630.

In one embodiment, the board 640 includes trapezoidal portions 642 located between adjacent grooves 644 (see FIG. 28A). In another embodiment, the grooves are triangular in cross-section and have triangular portions between adjacent grooves (see FIG. 28B illustrating board 650 with points 652 between adjacent grooves 654).

Figure 29:
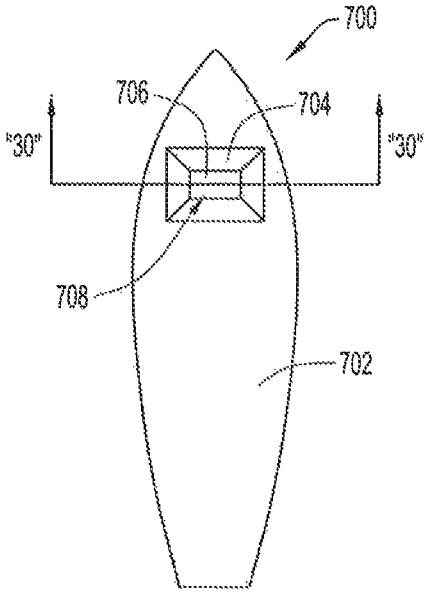
FIG. 29 illustrates a planar view of another embodiment of a board according to the present invention.
Figure 30:
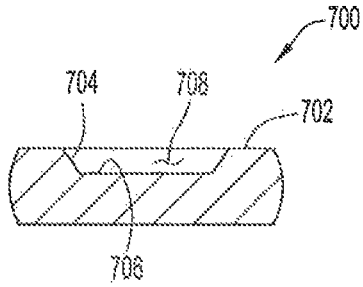
FIG. 30 illustrates a cross-sectional end view of the board illustrated in FIG. 29 taken along the line "29"-"29."

Referring to FIG. 29, an alternative embodiment of a board according to the present invention is illustrated. Board 700 includes a surface 702 that is proximate to the rear surface of a toy figure in the mermaid configuration. Formed in the surface 702 proximate to the location of the rear of the toy figure is a receptacle 708 that is defined by several angled surfaces 704 and a bottom surface 706, collectively. A cross-sectional view of the board 700 taken along the line "30"-"30" is illustrated in FIG. 30. The receptacle 708 is configured to receive part of the body of the toy figure when the toy figure is inserted into the fabric portion in the mermaid configuration. The engagement of the part of the toy figure body into the receptacle 708 results in the toy figure body being generally parallel to the board 700 and not oriented in a position away from the board 700.

Figure 31:
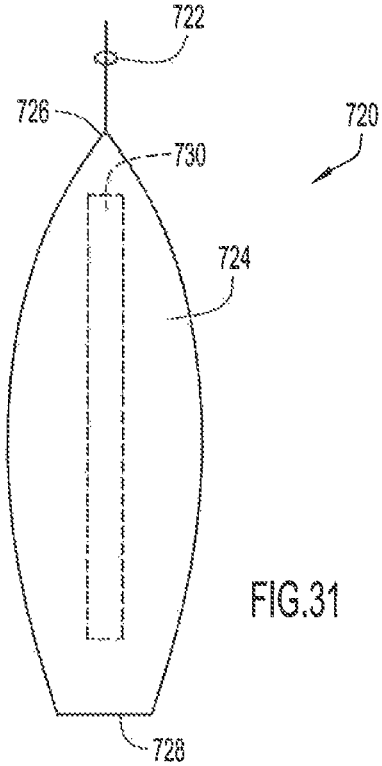
FIG. 31 illustrates a planar view of another embodiment of a board according to the present invention.

Referring to FIG. 31, another embodiment of a board according to the present invention is illustrated. In this embodiment, the board 720 has a body 724 with a longitudinal axis 722 and opposite ends 726 and 728. The board 720 includes an internal cavity or receptacle in which an elongate member 726, such as a rod, is located. The elongate member 726 extends along the longitudinal axis 722 and controls or limits the bending of the board 720 between ends 726 and 728.

In an alternative embodiment, the toy figure includes a button on the rear surface of the torso that can be used by a child to move the toy figure.

In one embodiment, the body of the toy figure and/or at least a portion of the hair of the toy figure includes color change material that is thermochromic or hydrochromic.

In an alternative embodiment, a thermoplastic insert, such as DELRYN, can be inserted between a surface of the surfboard 100 and the fabric member 120 prior to or as the toy FIG. 20 is inserted into the pocket 140. The thermoplastic insert is located between the toy FIG. 20 and the main portion of the surfboard, thereby contacting the back of the toy FIG. 20 for a better fit and retention of the toy FIG. 20 in the mermaid configuration.

In an alternative embodiment, in the surfer configuration, instead of the toy figure rotating 360 degrees about an axis, the toy figure can be moved by the handle or lever in a side-to-side manner.

In another embodiment, the handle attaches to the waist of the toy figure. This handle functions as an extension to hold the toy figure with ease during play.

It is to be understood that terms such as "left," "right," "top," "bottom," "front," "end," "rear," "side," "height," "length," "width," "upper," "lower," "interior," "exterior," "inner," "outer" and the like as may be used herein, merely describe points or portions of reference and do not limit the present invention to any particular orientation or configuration. Further, terms such as "first," "second," "third," etc., merely identify one of a number of portions, components and/or points of reference as disclosed herein, and do not limit the present invention to any particular configuration or orientation.

Although the disclosed inventions are illustrated and described herein as embodied in one or more specific examples, it is nevertheless not intended to be limited to the details shown, since various modifications and structural changes may be made therein without departing from the scope of the inventions. In addition, various features from one of the embodiments may be incorporated into another of the embodiments. Accordingly, it is appropriate that the invention be construed broadly and in a manner consistent with the scope of the disclosure.

What is claimed is:

1. A toy figure assembly, comprising:

a toy figure having a torso portion and pair of legs coupled to the torso portion, each of the legs including a foot; and a toy surfboard having a first side and a second side, the first side of the toy surfboard having couplers mounted thereto, the couplers being configured to receive the feet of the toy figure to support the toy figure in a first orientation so that the toy figure appears to be standing relative to the first side, the second side of the toy surfboard having a flexible member coupled thereto, the flexible member and the surfboard defining a pocket configured to receive the legs of the toy figure in a second orientation so that the toy figure appears to be wearing the flexible member.

2. The toy figure assembly of claim 1, wherein the flexible member includes a fabric member, the legs of the toy figure being insertable between the fabric member and the toy surfboard.

3. The toy figure assembly of claim 1, wherein the toy surfboard includes a fin member that is movable relative to the toy surfboard, the fin member being extendable and retractable relative to the pocket.

4. The toy figure assembly of claim 3, wherein the toy surfboard includes an actuator coupled to the fin member, the fin member being movable by the actuator from an extended position to a retracted position.

5. The toy figure assembly of claim 1, wherein the toy surfboard includes a mounting component that receives a portion of the toy figure to support the toy figure in a standing orientation on the toy surfboard.

6. The toy figure assembly of claim 1, wherein the toy surfboard includes a mounting component that receives a portion of the toy figure to support the toy figure in a lying orientation on the toy surfboard.

7. The toy figure assembly of claim 1, further comprising:

a handle coupleable to the toy figure, the handle being movable to impart motion to the toy figure and to the toy surfboard when the toy figure is coupled to the toy surfboard.

8. The toy figure assembly of claim 1, wherein the handle couples to the back of the toy figure.

* * * * *

UNITED STATES PATENT AND TRADEMARK OFFICE

CERTIFICATE OF CORRECTION

PATENT NO. : 8,894,463 B2
APPLICATION NO. : 13/315958
DATED : November 25, 2014
INVENTOR(S) : Patricia Chan, Steven Ryniker and Andrew Wong It is certified that error appears in the above-identified patent and that said Letters Patent is hereby corrected as shown below:

In the Specification

Column 4, Line 22, change "FIG." to --figure--
Column 4, Line 23, for each of the two (2) instances, change "FIG." to --figure--
Column 4, Line 25, change "FIG." to --figure--
Column 4, Line 30, change "FIG." to --figure--
Column 4, Line 34, change "FIG." to --figure--
Column 4, Line 36, change "FIG." to --figure--
Column 4, Line 37, change "FIG." to --figure--
Column 4, Line 38, change "FIG." to --figure--
Column 4, Line 40, change "FIG." to --figure--
Column 4, Line 42, change "FIG." to --figure--
Column 4, Line 43, change "FIG." to --figure--
Column 4, Line 44, change "FIG." to --figure--
Column 4, Line 46, change "FIG." to --figure--
Column 4, Line 57, change "FIG." to --figure--
Column 4, Line 58, change "FIG." to --figure--
Column 4, Line 66, change "FIG." to --figure--
Column 5, Line 5, change "FIG." to --figure--
Column 5, Line 8, change "FIG." to --figure--
Column 5, Line 13, change "FIG." to --figure--
Column 5, Line 16, change "FIG." to --figure--
Column 5, Line 23, for each of the two (2) instances, change "FIG." to --figure--
Column 5, Line 27, change "FIG." to --figure--
Column 5, Line 32, change "FIG." to --figure--
Column 5, Line 33, change "FIG." to --figure--
Column 5, Line 34, change "FIG." to --figure--
Column 5, Line 35, change "FIG." to --figure--
Column 5, Line 36, change "FIG." to --figure--

Signed and Sealed this
Twenty-sixth Day of May, 2015

Michelle K. Lee

Michelle K. Lee
*Director of the United States Patent and Trademark Office*

Column 5, Line 38, for each of the two (2) instances, change “FIG.” to --figure--
Column 5, Line 42, change “FIG.” to --figure--
Column 5, Line 43, change “FIG.” to --figure--
Column 5, Line 55, change “FIG.” to --figure--
Column 5, Line 64, change “FIG.” to --figure--
Column 5, Line 66, change “FIG.” to --figure--
Column 6, Line 5, change “FIG.” to --figure--
Column 6, Line 21, change “FIG.” to --figure--
Column 6, Line 23, change “FIG.” to --figure--
Column 6, Line 25, change “FIG.” to --figure--
Column 6, Line 29, change “FIG.” to --figure--
Column 6, Line 41, change “FIG.” to --figure--
Column 6, Line 44, change “FIG.” to --figure--
Column 6, Line 46, change “FIG.” to --figure--
Column 6, Line 51, change “FIG.” to --figure--
Column 7, Line 5, for each of the two (2) instances, change “FIG.” to --figure--
Column 7, Line 7, change “FIG.” to --figure--
Column 7, Line 8, change “FIG.” to --figure--
Column 7, Line 21, change “FIG.” to --figure--
Column 7, Line 22, change “FIG.” to --figure--
Column 7, Line 49, change “FIG.” to --figure--
Column 7, Line 57, change “FIG.” to --figure--
Column 7, Line 64, change “FIG.” to --figure--
Column 7, Line 65, change “FIG.” to --figure--
Column 7, Line 67, change “FIG.” to --figure--
Column 8, Line 18, change “FIG.” to --figure--
Column 8, Line 20, change “FIG.” to --figure--
Column 8, Line 21, change “FIG.” to --figure--
Column 8, Line 26, change “FIG.” to --figure--
Column 8, Line 30, change “FIG.” to --figure--
Column 8, Line 38, change “FIG.” to --figure--
Column 8, Line 57, for each of the two (2) instances, change “FIG.” to --figure--
Column 9, Line 3, change “FIG.” to --figure--
Column 9, Line 9, change “FIG.” to --figure--
Column 9, Line 26, change “FIG.” to --figure--
Column 10, Line 22, change “FIG.” to --figure--
Column 10, Line 28, change “FIG.” to --figure--
Column 10, Line 30, change “FIG.” to --figure--
Column 10, Line 37, change “FIG.” to --figure--
Column 10, Line 38, change “FIG.” to --figure--
Column 10, Line 42, change “FIG.” to --figure--
Column 10, Line 44, change “FIG.” to --figure--
Column 10, Line 47, change “FIG.” to --figure--
Column 10, Line 52, change “FIG.” to --figure--
Column 10, Line 59, change “FIG.” to --figure--

Column 11, Line 1, change “FIG.” to --figure--
Column 12, Line 23, change “FIG.” to --figure--
Column 12, Line 24, change “FIG.” to --figure--
Column 12, Line 25, change “FIG.” to --figure--
Column 12, Line 26, change “FIG.” to --figure--